US010206841B2

(12) United States Patent
Soltermann

(10) Patent No.: US 10,206,841 B2
(45) Date of Patent: Feb. 19, 2019

(54) ACTUATION SYSTEM FOR CONTROLLING THE MOVEMENT OF A TABLE

(71) Applicant: Aktiebolaget SKF, Gothenburg (SE)

(72) Inventor: Marcel Soltermann, Sankt Pantaleon (CH)

(73) Assignee: Aktiebolaget SKF, Göteborg (SE)

( * ) Notice: Subject to any disclaimer, the term of this patent is extended or adjusted under 35 U.S.C. 154(b) by 129 days.

(21) Appl. No.: 15/400,043

(22) Filed: Jan. 6, 2017

(65) Prior Publication Data

US 2018/0193216 A1 Jul. 12, 2018

(51) Int. Cl.
*A61G 13/02* (2006.01)
*A61G 13/04* (2006.01)
*A61G 13/06* (2006.01)

(52) U.S. Cl.
CPC ..... *A61G 13/04* (2013.01); *A61G 13/06* (2013.01); *A61G 13/02* (2013.01)

(58) Field of Classification Search
CPC ..... A61G 7/002; A61G 7/005; A61G 7/008; A61G 7/012; A61G 7/015; A61G 7/018; A61G 13/02; A61G 13/04; A61G 13/06; A61G 13/08
USPC ..... 5/607–611, 600, 613, 614, 616, 11
See application file for complete search history.

(56) References Cited

U.S. PATENT DOCUMENTS 2,217,783 A * 10/1940 Bell ..... A61G 13/02 5/607
2,520,455 A * 8/1950 Clachko ..... A61G 13/02 5/614
3,206,188 A * 9/1965 Douglass, Jr. ..... A61G 13/02 5/607
3,845,946 A * 11/1974 Warden ..... A61G 13/02 5/600
3,868,103 A * 2/1975 Pageot ..... A61G 13/02 137/596
4,958,817 A * 9/1990 Heller ..... A61G 13/04 5/607
5,398,356 A * 3/1995 Pfleger ..... A61B 6/04 5/601
5,528,782 A * 6/1996 Pfeuffer ..... A61G 13/02 108/147
5,621,933 A * 4/1997 Knapp ..... A61G 7/018 5/607

(Continued)

FOREIGN PATENT DOCUMENTS

DE 102017223076 A1 * 7/2018 ..... A61G 13/04

*Primary Examiner* — Robert G Santos
(74) *Attorney, Agent, or Firm* — Bryan Peckjian; SKF USA Inc. Patent Dept.

(57) ABSTRACT

An actuation system having a table, a lifting column for raising and lowering the table, first and second actuators pivotally mounted to a top section of the lifting column. The first and second actuators are coupled to a first end of the table. A guide plate having a top portion and at least one track is provided. The at least one track is slidingly engaged with at least one guide, the at least one guide is vertically mounted to a third side of the lifting column. The top portion of the guide plate is vertically driven by the third actuator and is universally coupled to a second end of the table. A controller for controls the movement of the lifting column in the vertical plane, and of the table in the longitudinal and lateral planes by varying the position of the three actuators relative to each other.

17 Claims, 7 Drawing Sheets

(56) References Cited

U.S. PATENT DOCUMENTS

| | | | | |
|---|---|---|---|---|
| 6,237,172 | B1 * | 5/2001 | Morgan, Sr. ..... | A61G 13/0018 5/600 |
| 6,721,976 | B2 * | 4/2004 | Schwaegerle ..... | A61G 13/04 5/507.1 |
| 6,886,199 | B1 * | 5/2005 | Schwaegerle ..... | A61G 13/04 5/507.1 |
| 6,928,676 | B1 * | 8/2005 | Schwaegerle ..... | A61G 13/04 16/334 |
| 8,800,983 | B2 * | 8/2014 | Koch ..... | A61G 13/02 248/652 |
| 2003/0145383 | A1 * | 8/2003 | Schwaegerle ..... | A61G 13/04 5/610 |
| 2012/0216350 | A1 * | 8/2012 | Koch ..... | A61G 13/04 5/607 |
| 2018/0193216 | A1 * | 7/2018 | Soltermann ..... | A61G 13/06 |

* cited by examiner

ACTUATION SYSTEM FOR CONTROLLING THE MOVEMENT OF A TABLE

FIELD OF THE INVENTION

The invention is related to an actuation system, more particularly to an actuation system for controlling the movement of a surgical or examination table.

BACKGROUND OF THE INVENTION

Surgical tables have two main tilting movements. One into the longitudinal axis of the table which is called Trendelenburg and Anti-Trendelenburg movement and one in the lateral direction which is called lateral movement. Manufacturers try to achieve high large movement range for all these movements. At the same time they would like to lower the lowest possible position as well as increase the highest possible position of the table.

A Cardan hinge is typically placed in the center of the table. Then two actuators are used, one for Trendelenburg/Anti-Trendelenburg and one for the lateral movement. A Cardan Hinge is a joint or coupling in a rigid rod that allows the rod to 'bend' in any direction, and is commonly used in shafts that transmit rotary motion. It consists of a pair of hinges located close together, oriented at 90° to each other, rigidly connected by a cross shaft. The universal joint is not a constant-velocity joint.

SUMMARY OF THE INVENTION

Embodiments of the disclosure may provide an actuation system including a table having vertical VP, longitudinal and lateral planes of movement, a lifting column for raising and lowering the table in the vertical plane of movement, first and second actuators pivotally mounted to a top section of the lifting column, the first and second actuators further coupled at their upper ends to a first end of the table, a guide plate having a top portion and at least one track, the at least one track being slidingly engaged with at least one guide, the at least one guide being vertically mounted to a third side of the lifting column, wherein the top portion of the guide plate is vertically driven by the third actuator and is universally coupled to a second end of the table, a controller for controlling the movement of the lifting column in the vertical plane VP, and of the table in the longitudinal and lateral planes by varying the position of the three actuators relative to each other, wherein the first and second actuators are unguided and can pivot unimpededly but only in the longitudinal and lateral planes of movement, wherein the universal joint is guided by the guide plate so that it only moves vertically and does not rotate around the vertical plane of movement and wherein the universal joint creates a torsion stiff connection with the table.

In a first aspect of the present invention the movement in the longitudinal plane is facilitated by the controlled individual vertical movements of the first, second and third actuators about the combination of pivot points PP1 and PP3, and pivot point PP2.

In a second aspect of the present invention the movement in the lateral plane is facilitated by the controlled individual movements of the first, second and third actuators about pivot point PP2.

In another aspect of the present invention the movement in the vertical plane is facilitated by the controlled individual movements of at least one of all three actuators acting in unison and the lifting column.

In another aspect of the present invention the vertical movement of the table is extended by the stroke of the three actuators when all three actuators are fully extended in an upward direction.

In another aspect of the present invention the vertical movement of the table is reduced by the stroke of the three actuators when all three actuators are fully retracted in a downward direction.

In another aspect of the present invention the table further provides at least one of a surgical table, a patient bed and a patient chair.

In another aspect of the present invention the universal connection provides a joint that can rotate in both the longitudinal and lateral directions.

In another aspect of the present invention the controlled movement of the three actuators is independent of speed.

In another aspect of the present invention the table can be tilted to reach 40 degrees in the longitudinal direction.

In another aspect of the present invention the table can be controlled to reach 30 degrees in the lateral direction.

In another aspect of the present invention due to the three actuator design, a maximum load per actuator is roughly one half as compared to a two actuator design with cardan hinge.

In another aspect of the present invention the load per actuator at least includes a patient to be oriented for a surgical procedure or to be examined.

In another aspect of the present invention the first, second and third actuators are at least one of electromechanically and hydraulically driven.

In another aspect of the present invention the lifting column provides a minimum of two interrelated tubes.

In another aspect of the present invention the controller sends output signals to first, second and third motors disposed within the column and first, second and third actuators, in order to drive the table into position, and wherein the actuators further comprise feedback that enables the controller accurately position the table.

In another aspect of the present invention the at least one track and the least one guide further comprise complementary ones of a linear track and guide track set and a cylindrical track and guide track set.

In another aspect of the present invention the universal connection creates a torsion stiff connection and does not rotate in the vertical plane VP.

In a final aspect of the present invention the first and second actuators are pivotally mounted to the column by multi-direction non-binding joints.

BRIEF DESCRIPTION OF THE SEVERAL VIEWS OF THE DRAWINGS

The invention will be better understood from the following detailed description of embodiments, representing non-limiting examples and illustrated by the accompanying drawings, wherein.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Hence, specific dimensions and other physical characteristics relating to the embodiments disclosed herein are not to be considered as limiting, unless the claims expressly state otherwise.

Figure 1:
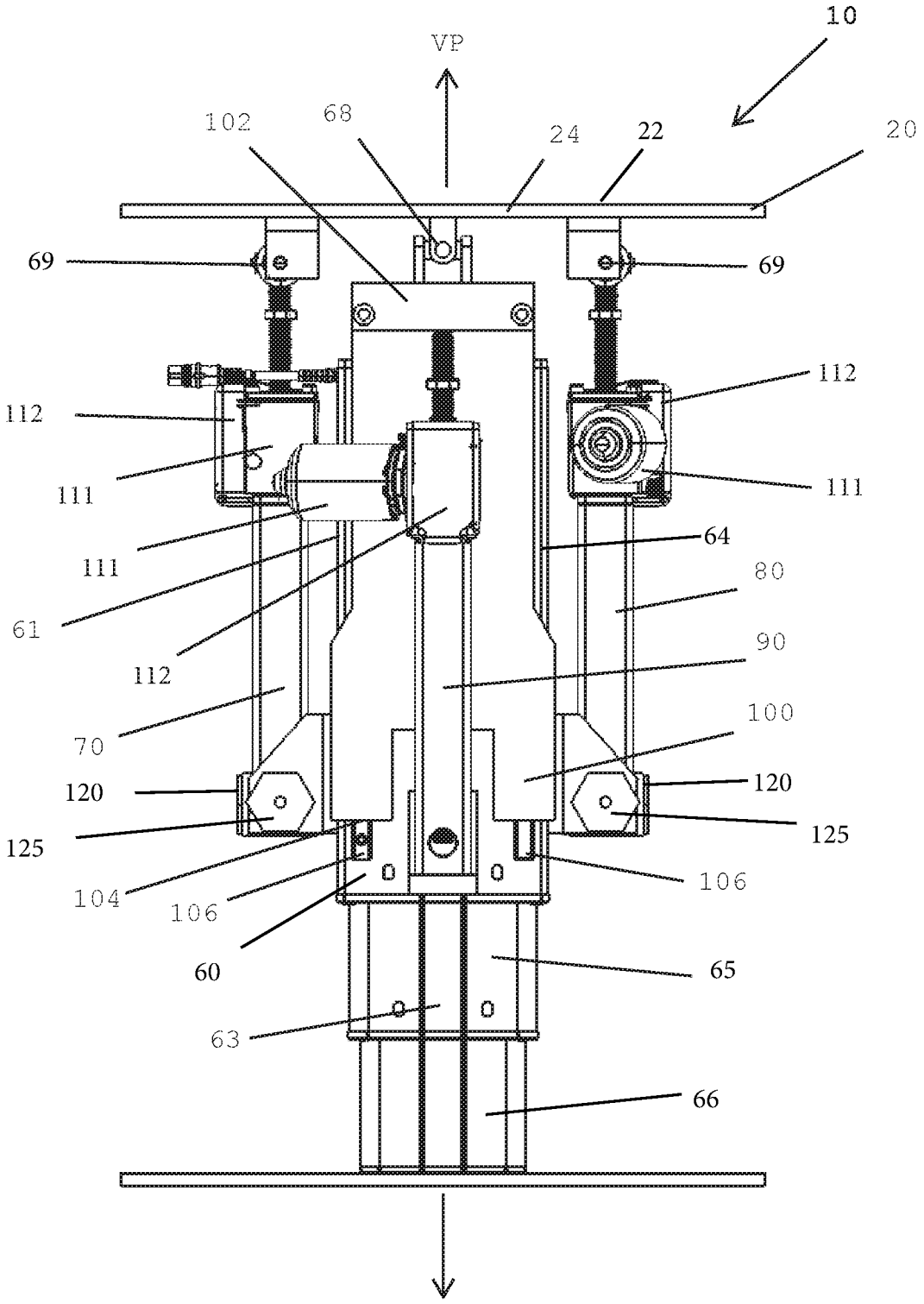
FIG. 1 is a front elevation view of an actuation system according to a first embodiment of the invention.

For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims.

An actuation system 10 that provides a table 20 and a lifting column 60 for raising and lowering the table 20 is illustrated in FIG. 1. The table 20 could be used to manipulate the position of a surgical table, a patient bed or chair. The lifting column 60 directs movement of the table 20 in a vertical plane VP of movement. The lifting column 60 provides a top section 64 and a minimum of two interrelated tubes 65 and 66. The actuation system 10 further provides first 70, second 80 and third 90 actuators. The first 70 and second 80 are mounted to the top section 64 of the lifting column 60. The first 70, second 80 and third 90 actuators can either be electromechanically or hydraulically driven.

At their lower ends, the first 70 and second 80 actuators can either be rigidly mounted to the top section 64 of the lifting column 60 or pivotally mounted to the lifting column 60. Here, the first 70 and second 80 actuators are shown pivotally mounted to the column by multi-direction non-binding joints 115, 120 and 125. See also FIG. 2 as well.

At their upper ends, the first 70 and second 80 actuators are secured via couplings 69 to a first end 22 of the table 20. The actuation system 10 may provide a guide plate 100 having a top portion 102 and at least one track 104. The at least one track 104 may provide a groove design that is slidingly engaged with at least one guide 106 that is designed to function like a tongue. The at least one guide 106 is vertically mounted to the top section 64 of the lifting column 60. Hence, the at least one track 104 and at least one guide 106 provide a snug tongue and groove assembly.

Here, the illustrated design shows two tracks 104 and two guides 106 that greatly minimizes play between the tracks and guides. As such, the minimized play between the tracks and guides transcends through the guide plate to minimize play through the guide plate and all the way up to the table. In an alternate embodiment, at least one cylindrical track and guide track set may be provided.

The third actuator 90 is mounted to the top portion 102 of the guide plate 100. The top portion 102 of the guide plate 100 is connected to a universal coupling 68. The universal coupling 68 is connected to a second end 24 of the table 20, which is vertically driven by the third actuator 90. As such, the universal coupling 68 creates a torsion stiff connection and does not rotate in the vertical plane VP.

Figure 2:
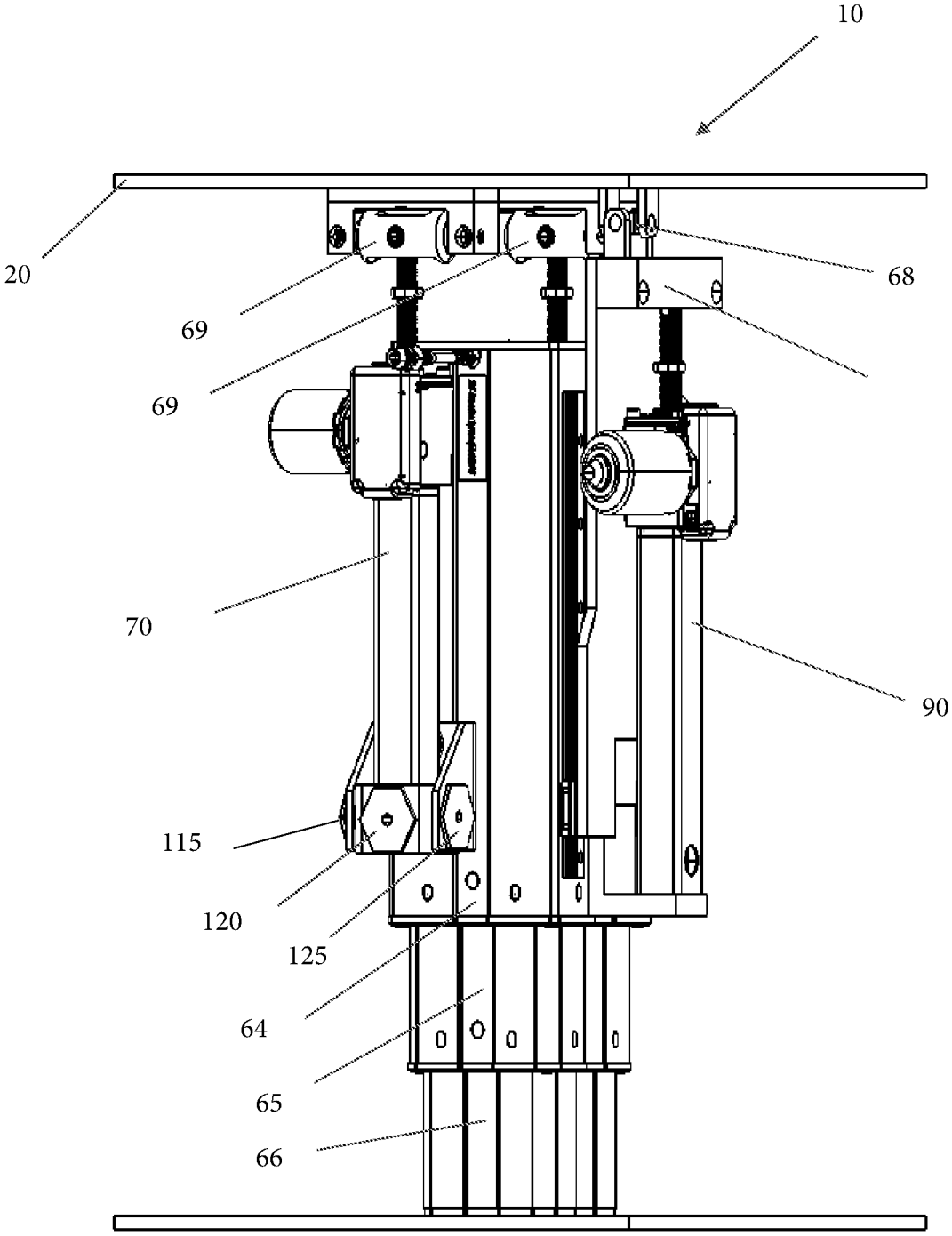
FIG. 2 is a right front elevation view showing the actuation system according to the first embodiment of the present invention.
Figure 3:
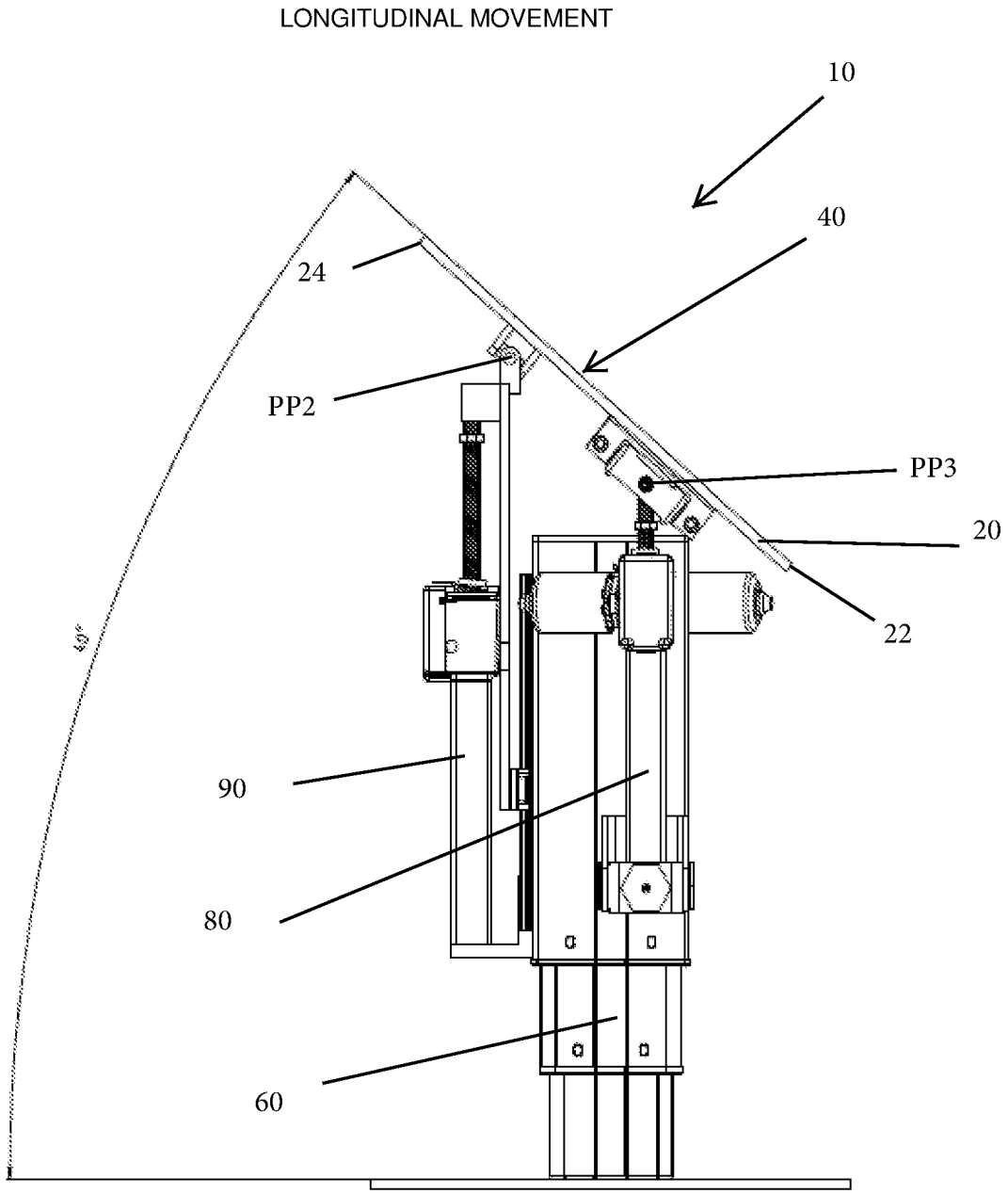
FIG. 3 is a left elevation view of the actuation system showing longitudinal table movement according to the first embodiment of the present invention.

FIG. 3 illustrates movement of the table 20 in a longitudinal plane 40. Movement in the longitudinal plane is facilitated by the coordinated individual vertical movements of the first 70, second 80 and third 90 actuators about pivot point PP2 and a combination of PP1 and PP3 in tandem. For example, if the third actuator is stationary, the first and second actuators work together in tandem to position the table as desired. As shown in FIG. 2, if it is desired to lift the first end 22 of the table, then the first and second actuators are driven to extend upwards. Thus, the table will lift upwards from the combination of pivot points PP1 and PP3 and about pivot point PP2. The same applies in the opposite. For example, if it desired to further lift the second end 24 of the table, then the third actuator is driven from PP2 to extend upwards and about pivot points PP1 and PP3. Accordingly, the table will lift upwards from PP2 and about the combination of pivot points PP1 and PP3. Consequently, the table can be tilted to reach 40 degrees in the longitudinal direction as shown.

Figure 4:
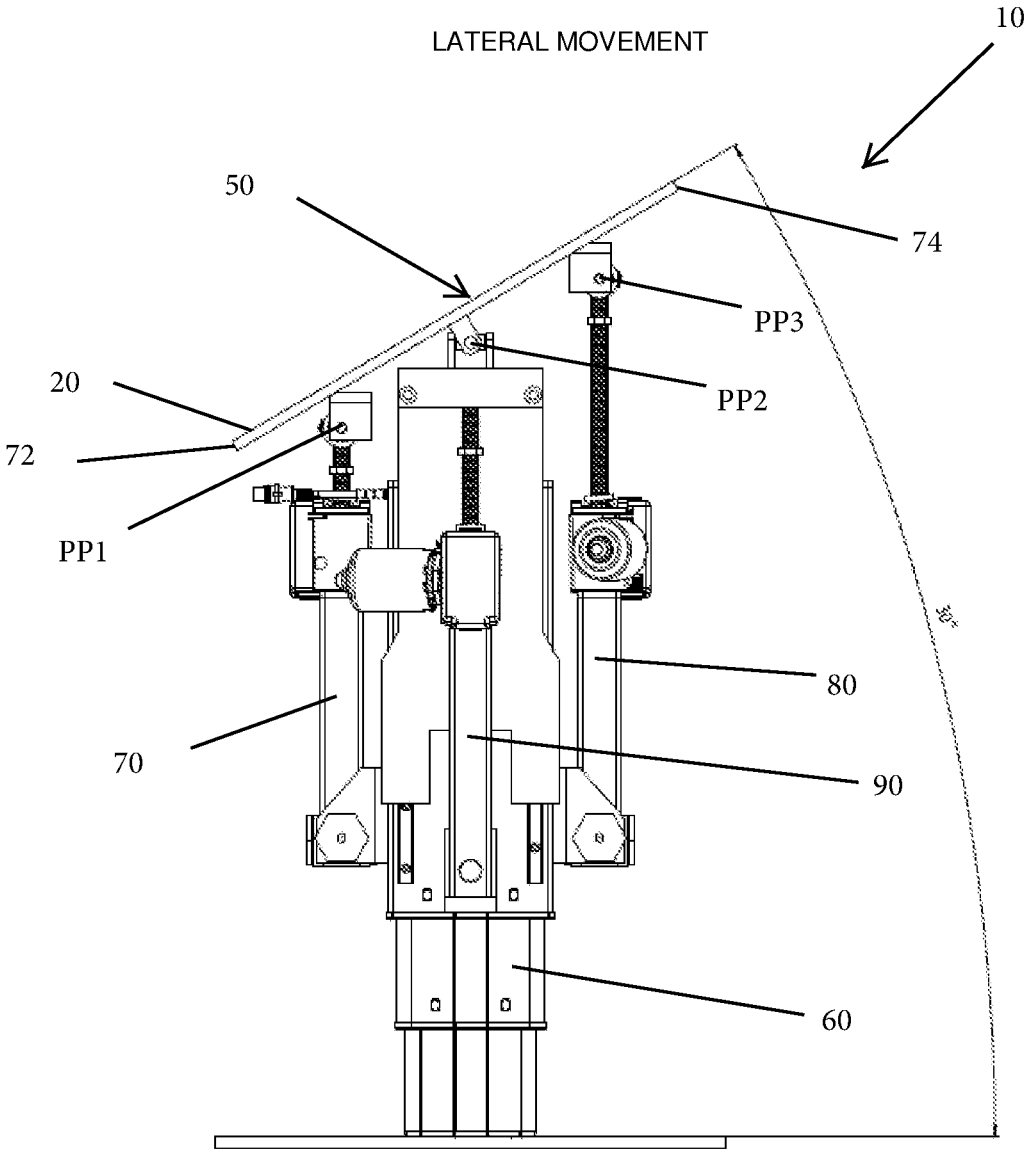
FIG. 4 is a left elevation view of the actuation system showing lateral table movement according to the first embodiment of the present invention.

FIG. 4 illustrates movement of the table 20 in a lateral plane 50. Movement in the lateral plane is facilitated by the controlled individual movements of the first, second and third actuators about pivot point PP2 with respect to PP1 and PP3 individually. For example, if the third actuator is held stationary, the first and second actuators work together to position the table as desired. As shown in FIG. 3, if it so desired to lift a third end of the table 72 laterally, then the first actuator is driven from PP1 to extend upwards while the second actuator is controlled to lower about PP3. Accordingly, the table will lift upwards from PP1 and about pivot points PP2 and PP3. The same applies in the opposite. For example, if it desired to further lift a fourth end 74 of the table, then the second actuator is further driven from PP3 to extend upwards and about pivot points PP1 and PP2. Accordingly, the table will lift upwards from PP3 and about the combination of pivot points PP1 and PP2. Consequently, the table can be controlled to reach 30 degrees in the lateral direction.

As previously mentioned FIG. 1 illustrates movement in the vertical plane VP. Movement in the vertical Plane VP may additionally be facilitated by the controlled individual movements of all three actuators 70, 80 and 90 acting in unison. As such, the vertical movement of the table may be extended by the stroke of the three actuators when all three actuators are fully extended in an upward direction. By contrast, vertical movement of the table may be reduced by the stroke of the three actuators when all three actuators are fully retracted in a downward direction.

Figure 5C:
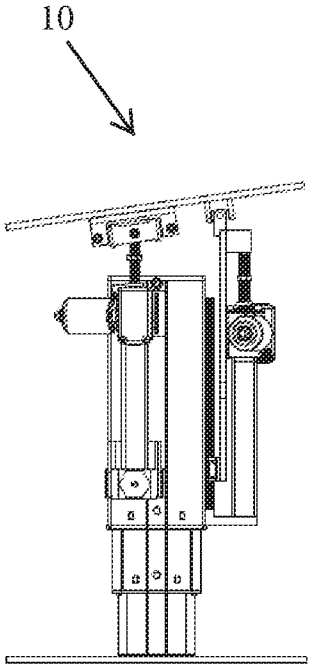
FIG. 5C is a left elevation view showing the table tilted according to the first embodiment of present invention.
Figure 5B:
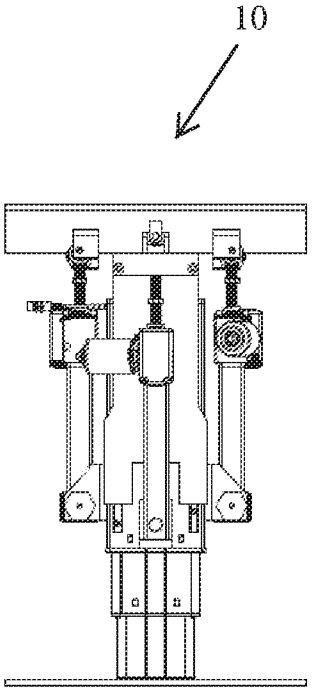
FIG. 5B is a front elevation view showing the table tilted according to the first embodiment of present invention.
Figure 5A:
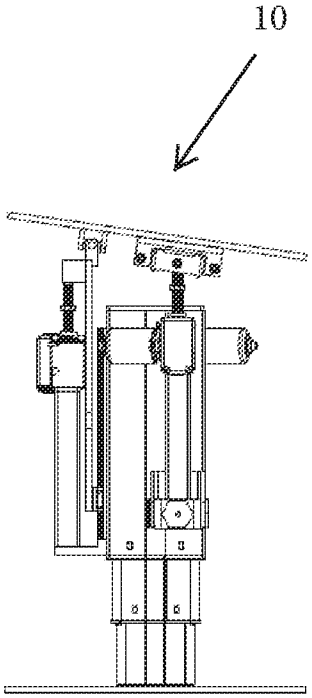
FIG. 5A is a right elevation view showing the table tilted according to the first embodiment of present invention.
Figure 6C:
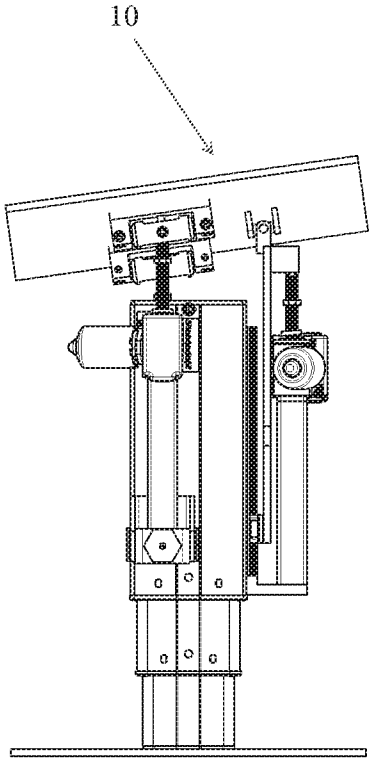
FIG. 6C is a left elevation view showing the table tilted according to the first embodiment of present invention.
Figure 6B:
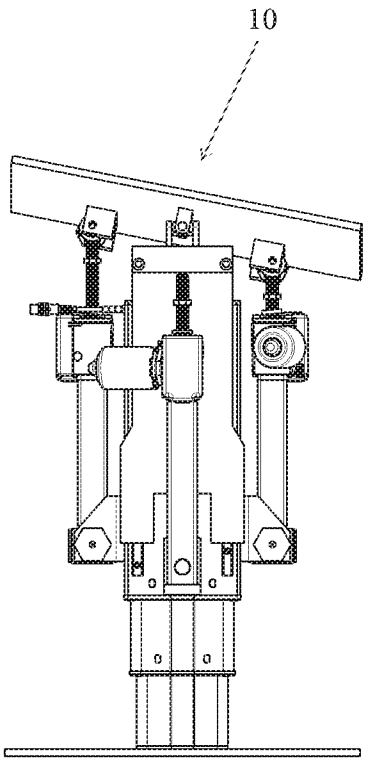
FIG. 6B is a front elevation view showing the table tilted according to the first embodiment of present invention.
Figure 6A:
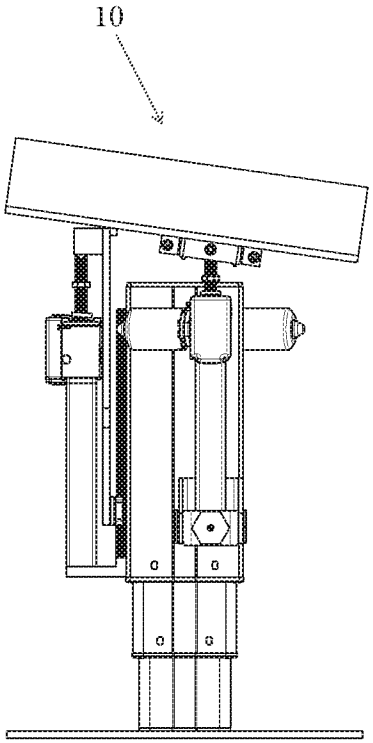
FIG. 6A is a right elevation view showing the table tilted according to the first embodiment of present invention.

FIGS. 5A, 5B and 5C show right, front and left views of the actuation system 10 with the table tilted in the longitudinal plane. FIGS. 6A, 6B and 6C show right, front and left views of the actuation system 10 with the table tilted in both the longitudinal and lateral planes of movement. These views show the versatility of the invention. In essence, the actuation system can be controlled to locate the table in an infinite number of positions.

Figure 7:
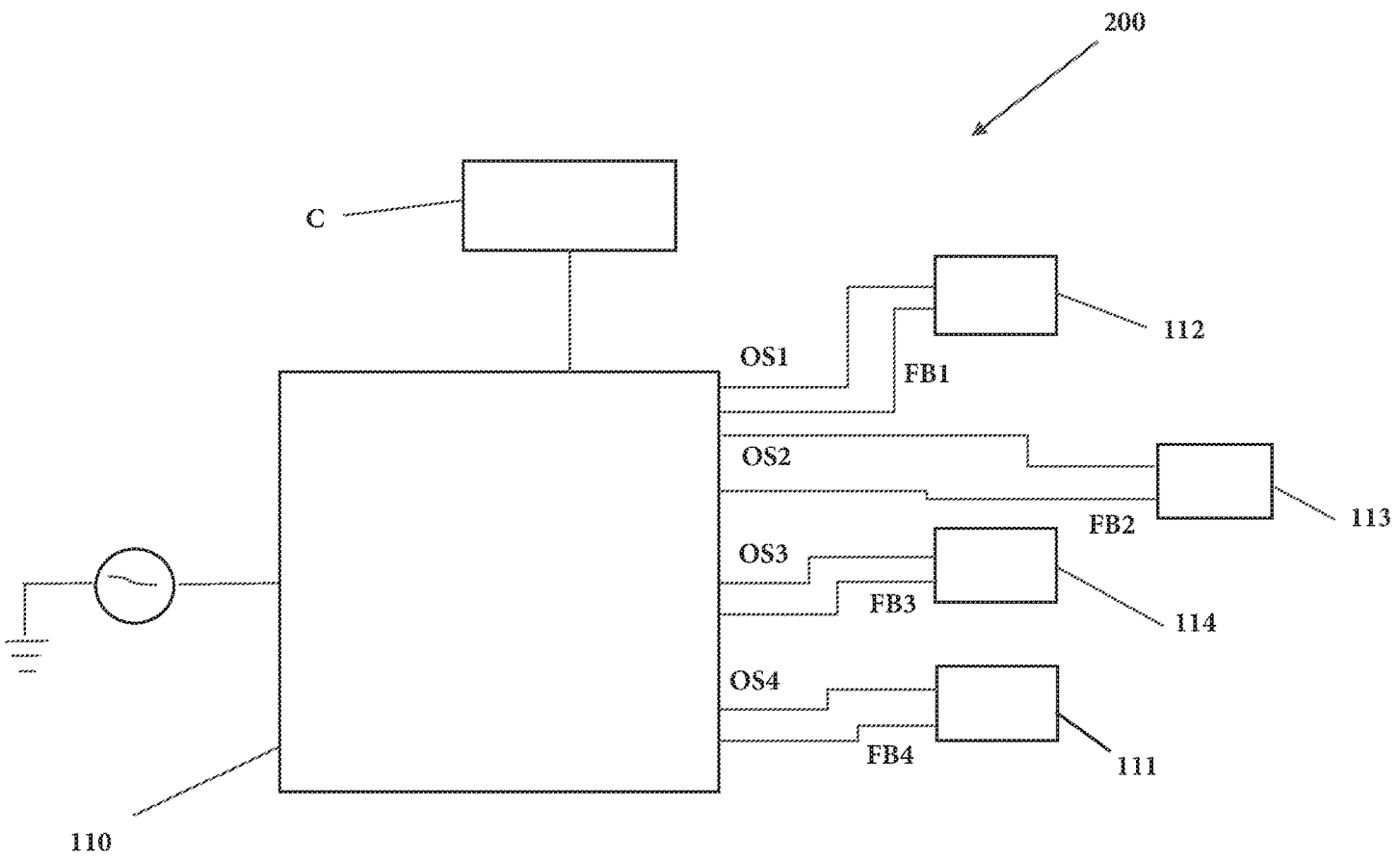
FIG. 7 is a plan view of a schematic diagram of the actuation system according to the first embodiment of present invention, and Like reference numerals refer to like parts throughout the various views of the drawings.

FIG. 7 depicts a circuit diagram 200 of the actuation system 10. As shown, the actuation system may provide a controller 110. The controller controls movement of the lifting column 60 in the vertical plane VP, and of the table 20 in the longitudinal 40 and lateral 50 planes by varying the position of the three actuators relative to each other. As such, the first 70 and second 80 actuators are unguided and can pivot unimpededly, but only in the longitudinal and lateral planes of movement. Universal joint 68 is guided by the guide plate so that it only moves vertically and does not rotate around the vertical plane of movement. Consequently, the universal joint 68 creates a torsion stiff connection with the table. However, the universal connection provides a joint that can rotate in both the longitudinal and lateral directions.

The controlled movement of the three actuators is independent of speed. The controller 110 sends independent output signals OS4, OS1, OS2 and OS3 respectively to a motor 111 in the column and first 112, second 113 and third motors 114 that are disposed within the first, second and third actuators, in order to drive the table 20 into position. The actuators may further provide first FB1, second FB2 and third FB3 feedback loops that enable the controller to accurately position the table. The same applies to the control of the column. It too provides feedback FB4 to the controller 110 in order to accurately position the vertical height of the table.

The actuation system may provide a control C that controls the controller. The control could be wireless, free standing, hanging or mounted to the table. A joystick or series of joysticks may be provided to control the controller. However, a series of switches could also be employed to carry out the vertical, longitudinal and lateral desired movements of the table. These examples are not meant to be limiting.

Due to the novel three actuator design, a maximum load per actuator is roughly half as compared to a two actuator design with cardan hinge. The load per actuator at least includes a patient to be oriented for a surgical procedure or to be examined. It should be noted that there is no cardan hinge mounted between the lifting column and table in the present invention.

The invention claimed is:

1. An actuation system comprising:

a table having vertical VP, longitudinal and lateral planes of movement, a lifting column for raising and lowering the table in the vertical plane of movement, first and second actuators pivotally mounted to a top section of the lifting column, the first and second actuators further coupled at their upper ends to a first end of the table, a guide plate having a top portion and at least one track, the at least one track being slidingly engaged with at least one guide, the at least one guide being vertically mounted to a side of the lifting column, wherein the top portion of the guide plate is vertically driven by a third actuator and is universally coupled to a second end of the table, a controller for controlling the movement of the lifting column in the vertical plane VP, and of the table in the longitudinal and lateral planes by varying the position of the three actuators relative to each other, wherein the first and second actuators are unguided and can pivot unimpededly but only in the longitudinal and lateral planes of movement, wherein the universal joint is guided by the guide plate so that it only moves vertically and does not rotate around the vertical plane of movement and wherein the universal joint creates a torsion stiff connection with the table.

2. The actuation system according to claim 1, wherein no cardan hinge is mounted between the lifting column and table.

3. The actuation system according to claim 1, wherein movement in the longitudinal plane is facilitated by the controlled individual vertical movements of the first, second and third actuators about the combination of pivot points PP1 and PP3 between the first and second actuators and the table, and pivot point PP2 between the top portion of the guide plate and the table, wherein movement in the lateral plane is facilitated by the controlled individual movements of the first, second and third actuators about pivot point PP2, and wherein movement in the vertical plane is facilitated by the controlled individual movements of at least one of all three actuators acting in unison and the lifting column.

4. The actuation system according to claim 3, wherein the controller sends output signals to the first, second and third motors disposed within the lifting column and the first, second and third actuators, in order to drive the table into position, and wherein the actuators further comprise feedback that enables the controller accurately position the table.

5. The actuation system according to claim 1, wherein the vertical movement of the table is extended by the stroke of the three actuators when all three actuators are fully extended in an upward direction.

6. The actuation system according to claim 1, wherein the vertical movement of the table is reduced by the stroke of the three actuators when all three actuators are fully retracted in a downward direction.

7. The actuation system according to claim 1, wherein the table further comprises at least one of a surgical table, a patient bed and a patient chair.

8. The actuation system according to claim 1, wherein the universal joint can rotate in both the longitudinal and lateral directions.

9. The actuation system according to claim 1, wherein the controlled movement of the three actuators is independent of speed.

10. The actuation system according to claim 1, wherein the table can be tilted to reach 40 degrees in the longitudinal direction.

11. The actuation system according to claim 1, wherein the table can be controlled to reach 30 degrees in the lateral direction.

12. The actuation system according to claim 1, wherein due to the three actuator design, a maximum load per actuator is roughly one half as compared to a two actuator design with a cardan hinge.

13. The actuation system according to claim 12, wherein the load per actuator is configured to at least include a patient to be oriented for a surgical procedure or to be examined.

14. The actuation system according to claim 1, wherein the first, second and third actuators are at least one of electromechanically and hydraulically driven.

15. The actuation system according to claim 1, wherein the lifting column provides a minimum of two interrelated tubes.

16. The actuation system according to claim 1, wherein the at least one track and the at least one guide further comprise complementary ones of a linear track and guide track set and a cylindrical track and guide track set.

17. The actuation system according to claim 1, wherein the first and second actuators are pivotally mounted to the lifting column by multi-direction non-binding joints.

* * * * *